United States Patent [19]

Jimenez et al.

[11] Patent Number: 5,042,406

[45] Date of Patent: Aug. 27, 1991

[54] PRESSER FOOT DEVICE FOR A SEWING MACHINE

[75] Inventors: Antonio Jimenez, Meyrin; Michel Combepine, Les Avanchets, both of Switzerland

[73] Assignee: Mefina S.A., Switzerland

[21] Appl. No.: 443,326

[22] Filed: Nov. 30, 1989

[30] Foreign Application Priority Data

Nov. 30, 1988 [CH] Switzerland ..... 4437/88

[51] Int. Cl.[5] ..... D05B 27/04; D05B 29/00

[52] U.S. Cl. ..... 112/237; 112/320

[58] Field of Search ..... 112/237, 236, 311, 320, 112/262.3

[56] References Cited

U.S. PATENT DOCUMENTS

| | | | |
|---|---|---|---|
| 1,602,140 | 10/1926 | Avis . | |
| 2,238,796 | 4/1941 | Knaus . | |
| 2,241,778 | 5/1941 | Giancola . | |
| 3,437,062 | 4/1969 | Hacklander . | |
| 4,166,422 | 9/1979 | Porter | 112/311 |
| 4,214,543 | 7/1980 | Garron et al. | 112/320 |
| 4,285,294 | 8/1981 | Aida | 112/311 |
| 4,417,536 | 11/1983 | Shiomi | 112/311 |
| 4,476,796 | 10/1984 | Vollmar . | |
| 4,480,566 | 10/1984 | Lukawich et al. . | |
| 4,686,917 | 8/1987 | Braun | 112/311 |

FOREIGN PATENT DOCUMENTS

| | | | |
|---|---|---|---|
| 614104 | 12/1926 | France . | |
| 2071170 | 9/1981 | United Kingdom | 112/236 |

*Primary Examiner*—Werner H. Schroeder
*Assistant Examiner*—Sullivan C. Prak
*Attorney, Agent, or Firm*—Cushman, Darby & Cushman

[57] ABSTRACT

In a sewing machine, a pivotable lever is provided in accordance with the present invention which carries a presser foot which is brought by an actuating device from a low position to a high position. In the low position the foot is applied to the material to be sewn. In the high position the foot is spaced from the material. The lever is equipped with rolling members which rest on guide ramps. The members and ramps have a profile such that during displacement of the presser foot between its two positions, the foot always follows a vertical path.

11 Claims, 4 Drawing Sheets

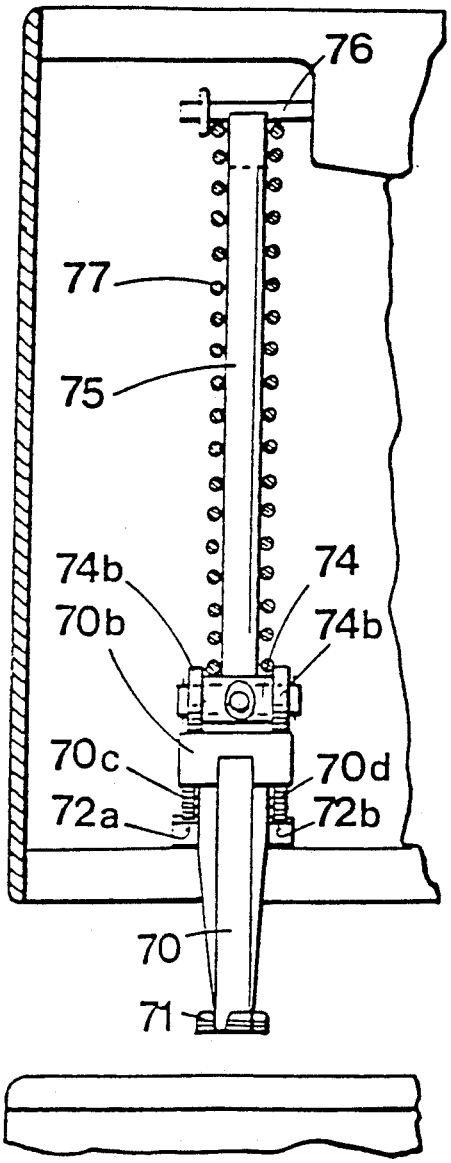
FIG. 2
FIG. 4
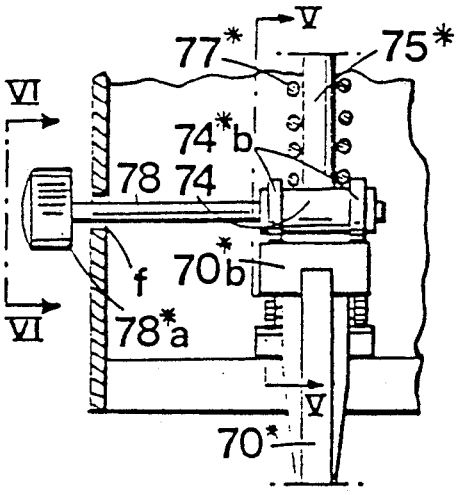
FIG. 3
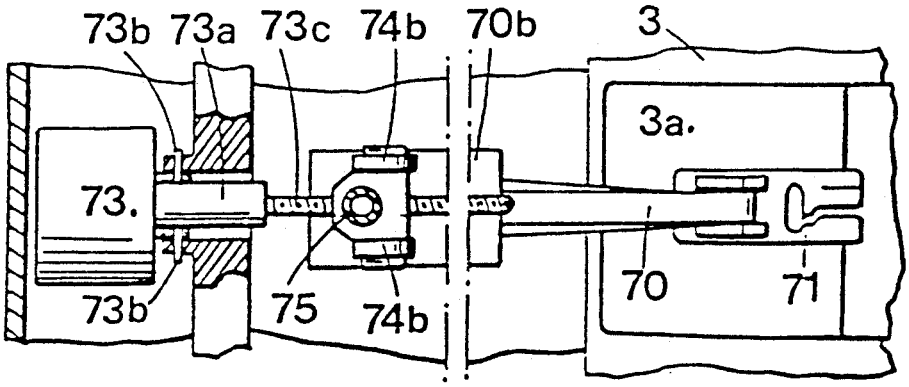

PRESSER FOOT DEVICE FOR A SEWING MACHINE

BACKGROUND OF THE INVENTION

The present invention relates to a pressure foot device for a sewing machine and, in particular, to a presser foot device including a tilting lever having an end which carries a presser foot and an actuating device which allows the lever to be brought into at least two angular end positions. In one of the angular end positions, a low position, the foot is applied onto the material to be sewn. In the other angular end position, a high position, the foot is spaced from the material to be sewn.

SUMMARY OF THE INVENTION

The presser foot device provided in accordance with the present invention is characterized in that an end of the lever carries at least one rolling member which rests on a guidance ramp. The profile of the ramp and/or the portion of the member in contact with the ramp is such that when the lever is tilted from one of its angular end positions to the other angular end positions, the foot fixed to the lever moves in a substantially vertical path.

BRIEF DESCRIPTION OF THE DRAWINGS

FIG. 2 is a front elevational view of the invention;

FIG. 3 is a plan view in partial section along line III—III of FIG. 1;

FIG. 4 is a partial view from the front of a first embodiment of the present invention;

DETAILED DESCRIPTION OF THE PRESENTLY PREFERRED EXEMPLARY EMBODIMENTS

Figure 1:
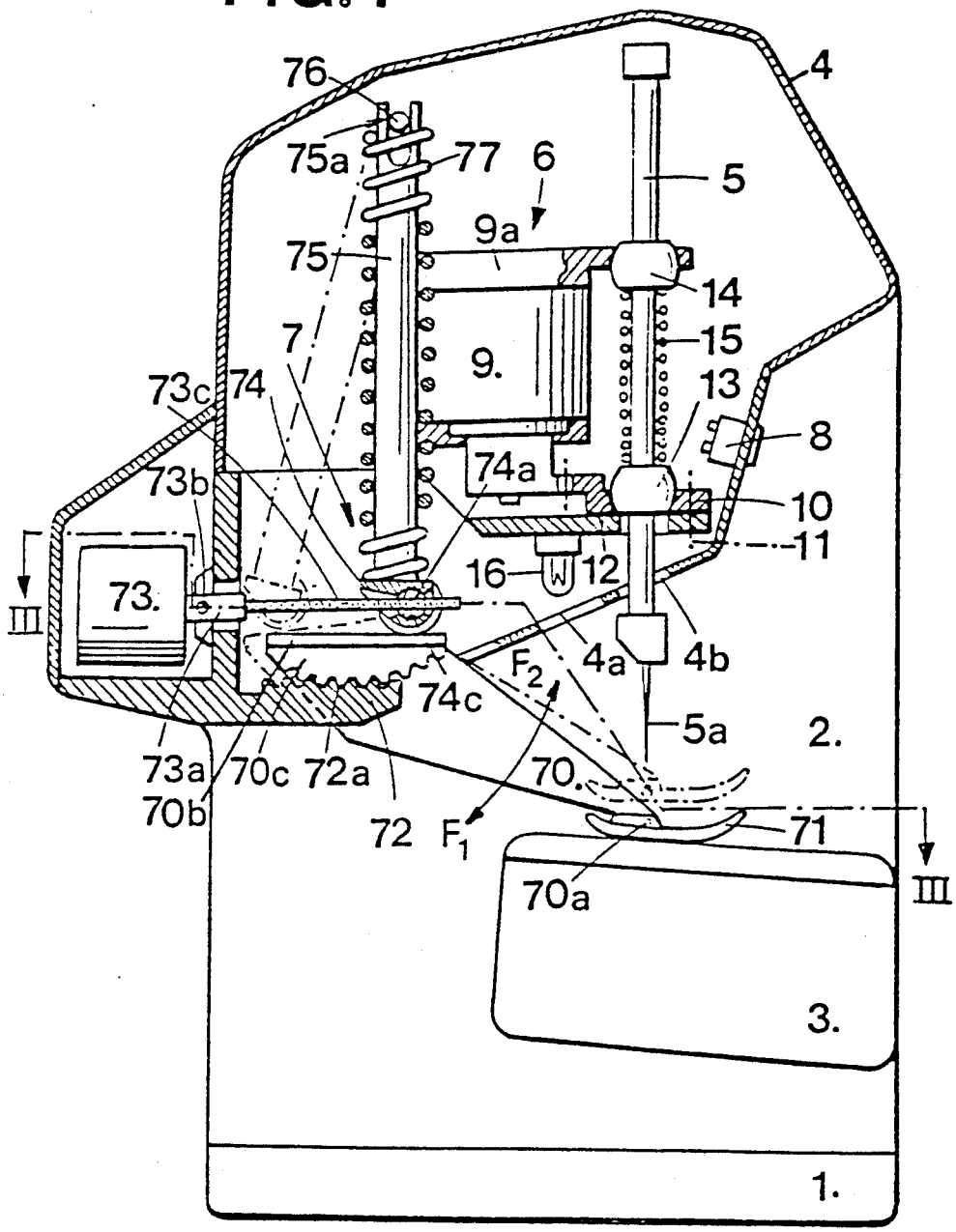
FIG. 1 is a side elevational view, partly in cross-section of the present invention.

In FIG. 1 of the drawings, 1 is the base of a case of a sewing machine on which a column 2 carrying two arms 3 and 4 is disposed. Arm 3 contains a loop pick-up device and its control mechanism as well as a feed device for the material to be sewn (not shown in particular). Arm 4 carries a mechanism (not shown) adapted to control the sliding back and forth of a needle bar 5 as well as a device 6 for driving bar 5 in its stitching movement and a presser foot device which is described in greater detail below.

The central motor of the sewing machine (not shown) which controls the driving of the loop pick-up device, the material to be sewn and the bidirectional vertical movement of the needle bar is disposed in column 2 alongside a step-down transformer and a rectifier assembly (not shown in the drawings) for electrical supply to the motor as well as to an electronic circuit (not shown) which groups in the form of solid state chips information-storing memories programmed for the control of the different functions of the sewing machine and one or more micro-processors on which this control depends. The assembly of the foregoing means, their interconnection and their respective functions are well known to a man of ordinary skill in the art and thus are not described in detail herein.

On the front right-hand surface of the sewing machine, as shown in the drawing, a control keyboard is provided. Only one switch 8 for the actuation of the presser foot device 7 is shown in FIG. 1.

Device 6 is of the type described in our copending U.S. application Ser. No. 07/443,359 filed Nov. 30, 1989.

Device 6 includes a stepper motor 9, on a vertical axis for control of the tilt of a lever 10, pivoted at 11 on a fixed support 12 and having a frustoconical opening forming a seat for the external surface of a bearing 13 which is disposed in alignment with a second bearing 14 having an identical structure to that of bearing 13 and engaged in a corresponding seat provided in the upper end plate 9*a* of the motor 9. Bearings 13 and 14 are maintained in their respective seats by a spring 15, placed under load between these bearings and traversed by needle bar 5.

A lamp 16 is fixed under support 12 for lighting the sewing area of arm 3 through a window 4*a* provided in the wall of arm 4. A second window 4*b* having an oblong shape permits passage of needle bar 5 and permits its stitching movements.

With reference to FIG. 1, presser foot device 7 includes a lever 70. At the right-hand end of lever 70, presser foot 71 is pivotally mounted by means of a pin 70*a*. Lever 70 is adapted to bring the presser foot into a low position or into a high position. The low position which is shown in solid lines is a position wherein the foot holds the material to be sewn against a needle plate 3*a* defined by the upper surface of arm 3 of the machine (FIG. 3) and more precisely on the gripper (not shown) for feeding material to be sewn from right to left as shown in the drawings or vice versa. The high position which is shown in broken lines is vertically spaced from the low position of foot 71. In the high position, material to be sewn may be clearly displaced by hand and, in particular, to position the part to receive the stitch under the needle 5*a* carried by needle bar 5.

Of particular note from the foregoing is that the presser foot provided in accordance with the present invention permits the formation of seams in portions of the material which has an even great thickness than other portions of the material without foot 71 blocking the material feed.

In effect, in accordance with the invention lever 70 may tilt with equal ease in either of directions $F_1$ and $F_2$ even when foot 71 is applied onto the cloth to be sewn. For that reason, the sewing machine of the invention may be applied to sewing folds of cloth of even substantial thickness.

To accomplish the foregoing, lever 70 carries on its left-hand part (FIG. 1) a flat and rectangular sole plate 70*b* extending to each side of the lever and having along the length of its longitudinal edges toothed sectors 70*c* and 70*d*. Each of the toothed sectors rest on a rectilinear rolling track 72*a*, 72*b*, respectively, (FIGS. 1 and 2) of toothed profile cut in the upper surface of bracket 72 which is integrated with the partially shown frame of the sewing machine.

As can be seen in the drawing, the pitch and shape of the teeth of the toothed sectors 70*c* and 70*d* and those of rolling tracks 72*a* and 72*b* are identical so that the teeth of the sectors perfectly engage those of the tracks.

If the tracks with the even-level toothing profile 72*a* and 72*b* are progressed upon by sectors 70*c* and 70*d* with the interdigitating toothing profile as a result of lever 70 being swung upward in the direction $F_2$, then sector 70*c* and 70*d* are literally rolled on the tracks 72*a* and 72*b* in the counterclockwise direction towards the left-hand side in the drawings, over a length compensating for, each instant, the displacement towards the right that foot 71 would unavoidably undergo as if the lever 70 was simply pivoted about a fixed axis.

A similar compensation but in the opposite direction takes place of course when lever 70 is brought from its position shown in broken lines to that shown in solid lines.

This schematic feature is made necessary by the fact that foot 71 must be capable of being raised even if needle 5*a* is in its lowest position and without meeting the needle.

It is to be understood that the structure of the invention could alternately be provided so as to have a rectilinear gear for sector 70*c* and 70*d*, rolling tracks 72*a* and 72*d* having a curvature appropriate to the required objective.

In accordance with another embodiment of the invention which is not shown in particular, sectors 70*c* and 70*d* and rolling track 72*a* and 72*b* may each have an arcuate profile of their own set out in such a manner as to permit obtaining the same type of operation as in the case of the configuration of FIG. 1.

It is to be understood, furthermore, that the sectors as well as the tracks may have no toothing at all but rather have a substantially smooth profile. However, in accordance with such a modification of the invention, the material for those parts must be selected so as to provide a good mutual adherence.

Figure 6:
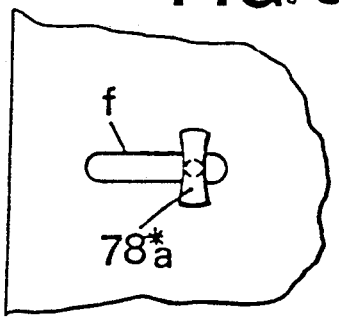
FIG. 6 is an view taken along line VI—VI of FIG. 4.
Figure 8:
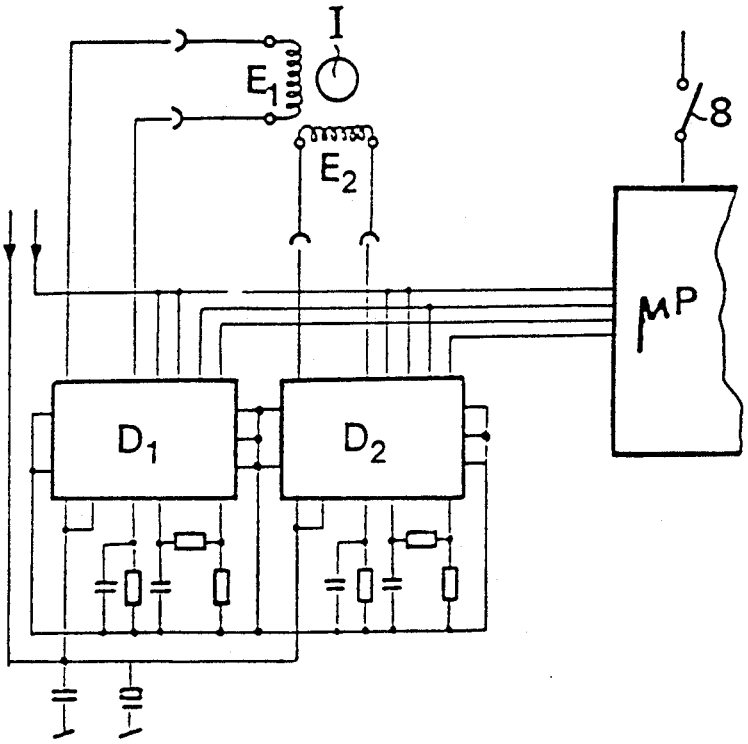
FIG. 8 is a schematic diagram of an electrical control circuit for a presser foot device provided in accordance with the invention.

Actuation of lever 10 may be either by means of a motorized control as shown in FIGS. 1 and 8, in particular, or by manual control of the type shown in FIGS. 4 and 6. It is, of course, possible to provide only for manual control, for example in less expensive sewing machines. On the other hand, it is possible to provide only for motorized control for high performance sewing machines and in particular machines such as microprocessor sewing machines. In the alternative, the sewing machine may incorporate both motorized control and manual control for the presser foot device.

Where motorized control is provided, a stepper motor 73 whose windings $E_1$ and $E_2$ (FIG. 8) are energized in an appropriate manner by drivers $D_1$ and $D_2$ which are controlled by a microprocessor P. The microprocessor P, in a computerized sewing machine, may also serve for general control of other operations of the machine. Activation of switch 8 causes pulse-type information to be sent to the microprocessor which selectively puts driver $D_1$ or driver $D_2$ in operation for a length of time sufficient to bring foot 71 from its low position to its high position and vice versa.

The casing of motor 73 carries a barrel 73*a* pivoted on the casing of the sewing machine by two pins 73*b* (FIGS. 1 and 3) which project outwardly from barrel 73*a* on each side thereof. The barrel is traversed by the left-hand end, as shown in the drawing, of a threaded rod 73*c* which extends as a continuation of the shaft (not shown) of the motor and engaged in a threaded passage 74*a* of a shaft 74*c* carrying roller 74*b*. Shaft 74*c* is a part of carriage 74 capable of rolling on sole plate 70*b* of lever 70 from the left end of the sole plate and vice versa according to the direction of rotation of threaded rod 73*c*. The length of the path of the carriage on sole plate 70*b* is determined by the number of control pulses supplied by the drivers $D_1$ and $D_2$ to windings $E_1$ and $E_2$ each time switch 8 is activated. This number will obviously be identical for each driver so that the path of the carriage will be the same in one direction or in the other direction of its displacement on sole plate 70*b*.

As can be seen in the drawing, carriage 74 is fixed to the lower end of a bar 75. The upper end of bar 75 is forked at 75*a* and slidingly embraces a guide rod 76 which is horizontally fixed to the casing of the machine.

A spring 77 is disposed about bar 75 and prestressed between rod 76 and carriage 74 against which it is engaged. The length of the spring is such that it remains underload even when bar 75 is disposed in its inclined position which is shown in broken lines in the drawing.

The assembly defined by bar 75, rod 76 and spring 77 forms a sort of thrust jack exerting its action on sole plate 70*b* of lever 70. The angular position of the level is determined by the position occupied at each instant by carriage 74 on sole plate 70*b*. It is to be remembered that the carriage may be displaced on the sole plate by rotation of threaded rod 73*c* in one direction or in the other according to the direction desired for movement of carriage 74.

In effect, as a lever 70 is free to tilt in direction $F_1$ or $F_2$ by rolling toothed sectors 70*c* and 70*d* on corresponding tracks 72*a* and 72*b*, it suffices that the vertical component of the force exerted by the spring 77 on carriage 74 passes to the left in FIG. 1 of the region of contact of the sectors 70*c* and 70*d* on these tracks so that lever 70 tilts in direction $F_2$ from its low position to its high position.

Lever 70 will take up its low position as soon as, by a movement in the opposite direction of carriage 74, the same vertical component of the force exerted by spring 77 passes beyond the region of contact of the lever towards the right.

In the low or working position of foot 71, it exerts a maximum pressure on the cloth against the grips (not shown) of the feeder mechanism. In effect, it is in this position of foot 71 that spring 77 develops its maximum depression force, because, with bar 75 occupying a vertical position, the deflection of the spring is then a maximum.

Thus, while sewing, if the thickness of the material arriving at a given instant under the presser foot is far greater than that of the rest of the material, the foot 71 and lever 70 will be raised by an amount corresponding to that thickness. At the limit, the lever 70 and foot 71 may even be brought momentarily into the high position which is shown in broken lines in the drawing, allowing passage of the extra thickness of material without blocking the machine.

In effect, in such a case bar 75 will rise vertically by sliding of its forked extremities 75*a* on rod 76 and compressing spring 77. The bar will again take up its usual axial position without jerking by relaxation of spring 77 as soon as foot 71 has passed over the instantaneous extra thickness of the material.

Thus foot 71 and lever 70 are mounted in a floating configuration which allows them to absorb with ease any obstacle presented by the surface of the piece to be sewn, even of relatively great thickness, as is the case when assembling several layers of heavy denim-type canvas material or of corduroy, for example.

Figure 5:
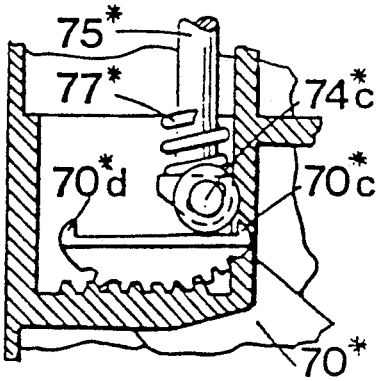
FIG. 5 is a part-sectional view taken along line V—V of FIG. 4.

As noted above, the presser foot device provided in accordance with the invention need only provide for manual control of the type shown by way of example in FIGS. 4–6.

In accordance with that embodiment of the invention, motor 73 and its adjoining parts as well as the circuit shown in FIG. 8 are eliminated with corresponding modifications in the casing of the sewing machine. Accordingly, the drive of carriage 74 on the sole plate 70*b* of the lever 70* will be carried by corresponding horizontal displacement, manually effected, of a pull handle 78* fixedly attached to carriage 70*b* and traversing a slot formed in the casing of the machine. This pull handle may be controlled by the user by the action of the fingers on a button 78*a* fixed at the free end of the handle (FIGS. 4 and 6).

The path of carriage 74* on the sole plate 70*b* of lever 70* is limited by rollers 74*b* meeting two pairs of stops, 70*d* and 70*c*, depending upon the direction of displacement of a carriage (FIG. 5).

Figure 7:
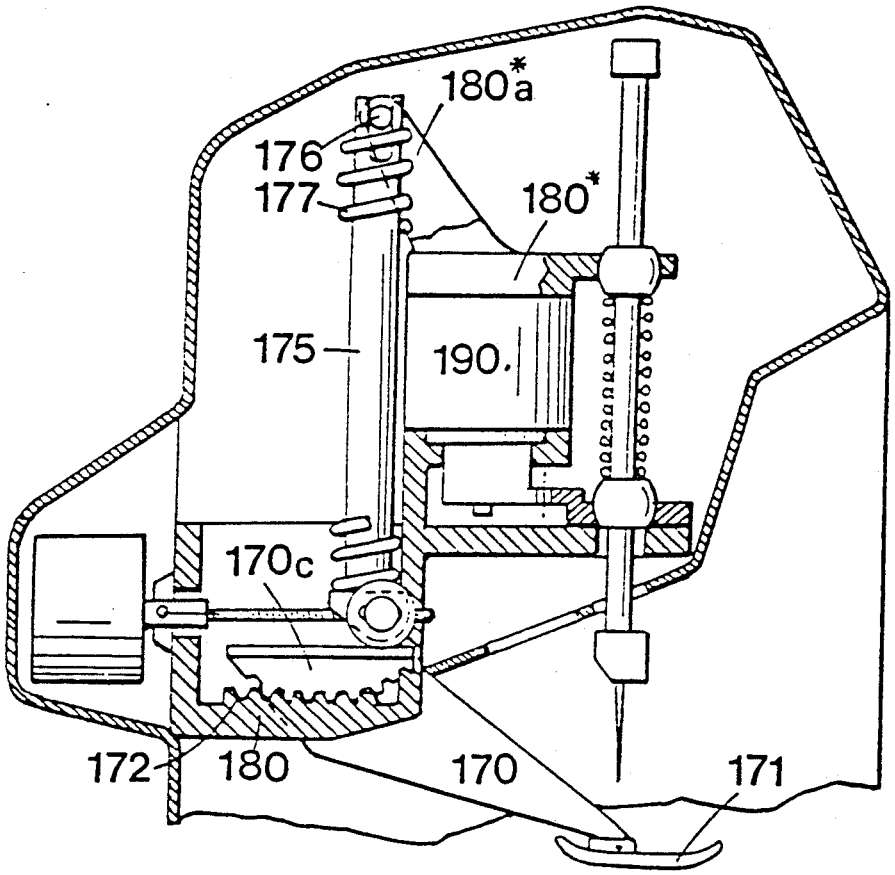
FIG. 7 is a detailed view, partially in cross-section of a second embodiment of the invention.

In a particularly advantageous embodiment which is shown in FIG. 7, rolling tracks 172 adapted for the toothed sectors 170*c* of the lever 170 carrying foot 171 may be cut in a single piece 180 which forms at the same time as the lower end plate for a stepper motor 190 for the control of the switching movement of the needle bar of the machine. The upper end plate of this motor, 180*, may comprise a fork 180*a* at the end of which is fixed rod 176 permitting the axial sliding of bar 175 of the pressure jack formed by this bar and co-operation with a spiral spring 177.

The structure of the invention as recited above allows the presser foot device and the control device for switching action of the needle bar as well as the needle bar to be formed as a single assembly which can be manufactured in a self-contained manner independently of the remainder of the sewing machine and incorporated into the sewing machine at the time of final assembly.

The structure of the invention permits, furthermore, facilitated service after sale, particularly where repairs must be carried out in a remote location. Indeed, with the foregoing structure, the presser foot, control device and needle bar assembly may be disassembled from the remainder of the machine for shipping and repair and re-incorporated in the sewing machine prior to return to the customer.

The invention is of course not limited to the specific embodiments discussed herein. Indeed, for example, the spring jack shown in FIG. 1 may be replaced by a hydraulic automatic jack.

Furthermore, in order to adapt to the force exerted by the device on the material to be sewn as a function of the nature of that material, it is possible to provide a control circuit similar to that of FIG. 8 but wherein windings $E_1$ and $E_2$ only receive one motorized pulse for actuation of switch 8. In this manner, the jack may be brought into any intermediate position located between the right-hand end of the sole plate 70*b*, 170*b* in the region of contact of sectors 70*c* and 70*d*, 170*c* on the rolling tracks 72*a* and 72*b*, 172, respectively, and thus vary the magnitude of the vertical component of the force developed by the jack on the sole plate and thus on the presser foot. In addition, one may obtain a substantial modulation of the above effect by giving the surface of sole plate 70*b*, 170*b* a profile which is different from the profile in the illustrated embodiment in such a manner as to precisely vary the state of compression of the spring of the jack as a function of the position occupied at each instant by the carriage 74 on the sole plate.

In accordance with yet a further embodiment of the invention (not shown in particular), the adaptation mentioned above may be automatic by virtue of a computerized program used by the microprocessor of the circuit shown in FIG. 8 and which may be accessed by different control buttons each corresponding to a different position of the jack on sole plate 70*b*, 170*b*. That is, corresponding to an optimal pressure exerted by the presser foot of the machine on the material to be sewn according to the characteristics of the material and the nature of the pattern to be sewn.

We claim:

1. A material presser device for a sewing machine comprising:

a tilting lever having first and second ends;

a presser foot mounted to said first end of said tilting lever; and an actuating device for moving said tilting lever selectively into at least two angular end positions, one of said end positions being a low position wherein said presser foot is applied to a material to be sewn, the other of said end positions being a high position wherein said foot is spaced from the material, said second end of said tilting lever having a rolling member for resting on a guide ramp, at least one of a profile of said ramp and a profile of a portion of said rolling member in contact at each instant with said ramp being such that when said tilting lever is moved from one of said at least two angular end positions to the other of said at least two angular end positions, the presser foot moves along a substantially vertical path.

2. A device according to claim 1, wherein said portion of said rolling member and said guide ramp each having a corresponding, interdigitating toothed profile, respective toothed portions of said rolling member and said guide ramp being in mutual interdigitating contact.

3. A device according to claim 2, wherein said first and second rolling members are defined on said second end of said tilting lever, one of said rolling members being disposed on each lateral side of said tilting lever and wherein first and second guide ramps are provided, one disposed so as to be in contact with each of said rolling members.

4. A device according to claim 3, wherein the rolling members are mounted on a thrust-resistant sole plate and wherein said actuating device includes a jack having a thrust end, said thrust end of said jack being applied against said sole plate, and means permitting displacement of the point of engagement of the jack on the sole plate from a first area of the sole plate to a second area of the sole plate spaced from said first area and said thrust end being movable from said second area to said first area by rolling said rolling members on said guide ramps, said first area being disposed with respect to the region of contact of said rolling members with said corresponding guide ramp so that said tilting lever couples said low position and said second area being disposed on an opposite side of said region of contact from said first area, corresponding to said tilting lever occupying its high position.

5. A device according to claim 4, wherein said jack is one in which said energy is resiliently stored.

6. A device according to claim 5, wherein said jack comprises a rigid and elongate member, one end of said rigid and elongate member engaging against said thrust-resistant sole plate and the other end of which is pivoted at a fixed joint and a spiral spring disposed in surrounding relation to said rigid and elongate member, said spiral being compressed between said first end of said member and said second end so that the spring exerts a thrust on said sole plate irrespective of a point of engagement of the jack on the sole plate.

7. A device according to claim 6, comprising means for controlling pivoting of said rigid and elongate member.

8. A device according to claim 7, wherein the end of the jack which is applied against said sole plate includes a carriage accommodating rolling members for rolling on the sole plate.

9. A device according to claim 7, including a rod operatively coupled to said carriage, said rod being displaceable along the length of said sole plate.

10. A device according to claim 8, wherein said carriage comprises a nut having an axis parallel to a desired path of the carriage on said sole plate and further comprising a stepper motor having a shaft which controls rotation of a threaded rod in contact with said nut and a controlled circuit for the motor for delivering pulses to the motor sufficient in number to drive the carriage on the sole plate between two predetermined areas of the surface of the sole plate corresponding respectively to said high position and said low position of the presser foot, said pulses having a polarity indicative of the driving direction.

11. A device according to claim 10, wherein a casing is provided for the motor, said casing being pivotable about a horizontal axis so that said threaded rod follows variations in the position of the carriage with respect to a horizontal reference plane during displacement of the carriage on the sole plate.

* * * * *